United States Patent [19]

Lundquist

[11] 4,179,769

[45] Dec. 25, 1979

[54] VACUUM CLEANER ATTACHMENT FOR VACUUMING LIQUIDS

[76] Inventor: Robert H. Lundquist, 1850 N. 500 East, Provo, Utah 84601

[21] Appl. No.: 952,640

[22] Filed: Oct. 19, 1978

[51] Int. Cl.[2] ..... A47L 7/00

[52] U.S. Cl. ..... 15/353; 55/417; 141/59

[58] Field of Search ..... 55/417, 415, DIG. 3; 15/353, 320, 321; 137/205; 141/59

[56] References Cited

U.S. PATENT DOCUMENTS

| | | | |
|---|---|---|---|
| 1,454,381 | 5/1923 | Stepp | 15/321 X |
| 2,317,589 | 4/1943 | Collinson | 137/205 X |
| 2,607,068 | 8/1952 | Minerley | 15/353 X |
| 3,612,089 | 10/1971 | Beguiristain | 137/205 |
| 4,112,538 | 9/1978 | Bates | 15/321 |

*Primary Examiner*—Christopher K. Moore

*Attorney, Agent, or Firm*—Criddle, Thorpe & Western

[57] ABSTRACT

A portable attachment for tank-type vacuum cleaners is provided which permits pickup of liquids as well as solids with the aspirated air. The attachment comprises a portable container having a removable cover thereon which makes a substantially air-tight connection with the container. A pair of nozzles are provided on the cover for fluid flow communication between the inside and outside of the container. One of the nozzles is adapted to have the suction hose of a tank-type vacuum attached thereto, while a scavenger hose for conveying a mixture of air, dirt particles, and liquid to the container is attached to the other nozzle. Valve means in combination with the first nozzle is spring biased in the closed position so that fluid flow communication between the inside of the container and the suction hose of the vacuum cleaner is established only when the valve means is activated to its open position.

4 Claims, 4 Drawing Figures

VACUUM CLEANER ATTACHMENT FOR VACUUMING LIQUIDS

BACKGROUND OF THE INVENTION

1. Field

The invention is directed broadly to the field of vacuum cleaning devices which are capable of picking up liquids as well as solids with the aspirated air. In particular, the invention relates to a portable attachment for conventional, tank-type vacuum cleaners which permits liquid pickup by the aspirated air.

2. State of the Art

Large, bulky, canister, vacuum cleaners are commercially available which are designed to pick up liquids and solids with the aspirated air. Such cleaners have been used in commercial applications such as for wet cleaning of floors in large buildings. However, due to a combination of the bulky size of such cleaners and their formidable costs, they have not been used to any significant extent in household applications. A portable unit which could be used in combination with conventional tank-type vacuum cleaners for occasional use in vacuuming up liquids on various occasions.

OBJECTIVES

The principal objective of the present invention is to provide a portable accessory which can easily and quickly be attached to conventional canister or tank-type vacuum cleaners for use in vacuuming up liquids. In particular, it is an objective to provide a unit which can readily be used but yet easily controlled to avoid liquid intake by the vacuum cleaner unit itself.

SUMMARY OF THE INVENTION

The above objectives are achieved in accordance with the present invention by providing a portable attachment for vacuum cleaners, preferably canister, i.e., tank-type vacuum cleaners. The attachment comprises a portable container capable of holding a liquid. The container is provided with a removable cover which makes a substantially air-tight connection therewith. A pair of nozzles are located on the cover, with each nozzle providing for fluid flow communication between the inside and outside of the container. One of the nozzles has means associated therewith for attaching the suction hose of a vacuum cleaner thereto. Valve means is also provided in combination with that nozzle, with the valve means being spring biased in the closed position so that fluid flow communication between the inside of the container and a suction hose attached to the outside of the nozzle is established only when the valve means is activated to its open position. A scavenger hose is attached to the other nozzle on the cover of the container. The scavenger hose is adapted to convey a mixture of air and liquids to the container. The liquid is collected in the container, and the air is further aspirated from the container through the first nozzle and suction hose to the vacuum cleaner.

In operation, the suction hose of a vacuum cleaner is attached to the appropriate nozzle on the cover of the container. The cover, of course, is securely attached to the container. The vacuum cleaner is turned on, and while holding the container upright, the valve means associated with the nozzle which is connected to the suction hose of the vacuum cleaner is activated to its open position. Air is aspirated through the scavenger hose and container creating an air suction at the free end of the scavenger hose. The free end of the scavenger hose is directed to a wet area where liquid is picked up by the air suction, and the liquid is conveyed to the container.

Other features and advantages of the invention will become apparent from the following detailed description, taken together with the accompanying drawings.

THE DRAWINGS

DETAILED DESCRIPTION OF THE ILLUSTRATED EMBODIMENT

Figure 1:
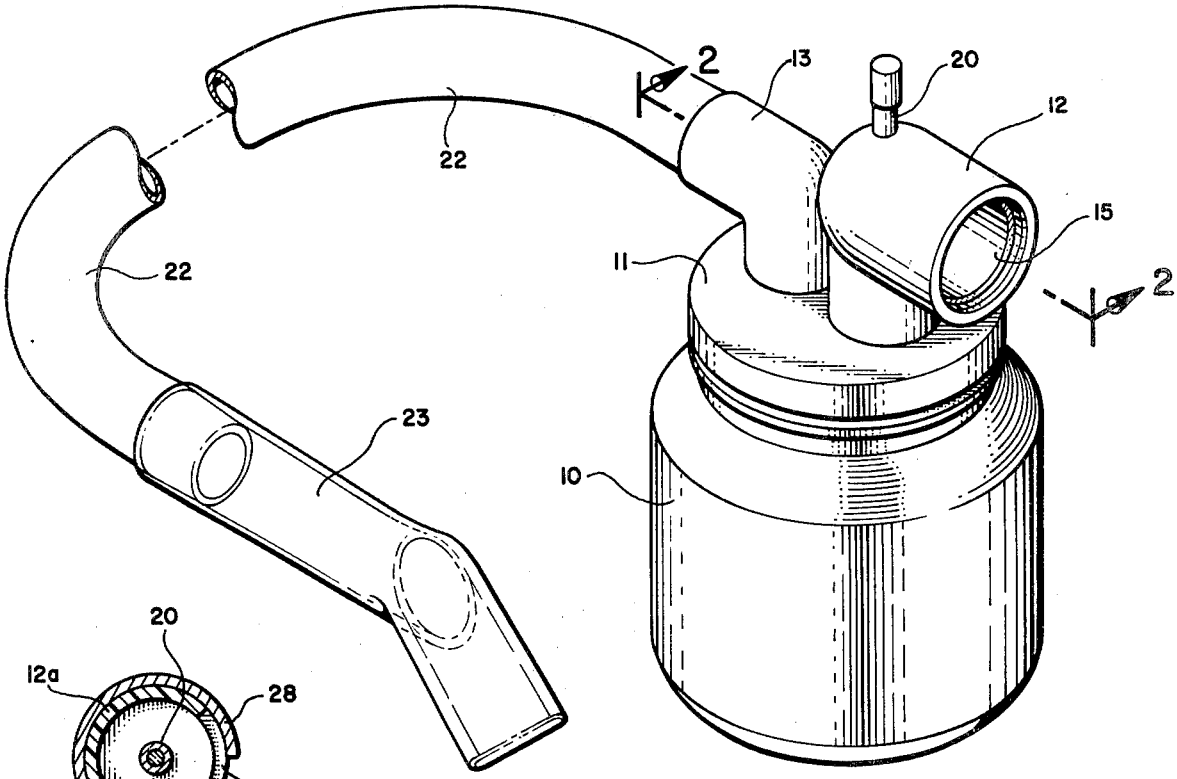
FIG. 1 is a perspective view of a preferred embodiment of a portable attachment unit for a vacuum cleaner in accordance with this invention.

As illustrated in the drawings, a preferred embodiment of the attachment unit of the present invention comprises a container 10 having a removable cover or lid 11 which makes a substantially air-tight connection with the container 10. A pair of nozzles 12 and 13, respectively, are positioned on the cover 11, with each nozzle providing fluid flow communications between the inside and outside of the container 10.

The first nozzle 12 is adapted to be connected to the suction hose 14 (shown in dotted lines in FIGS. 2 and 3) of a tank-type vacuum cleaner. As shown, the end of the suction hose 14 fits within the outside opening of the nozzle 12. A compression ring 15 can be provided on the inside of the nozzle opening to make a tight fit with the end of the suction hose 14.

Figure 3:
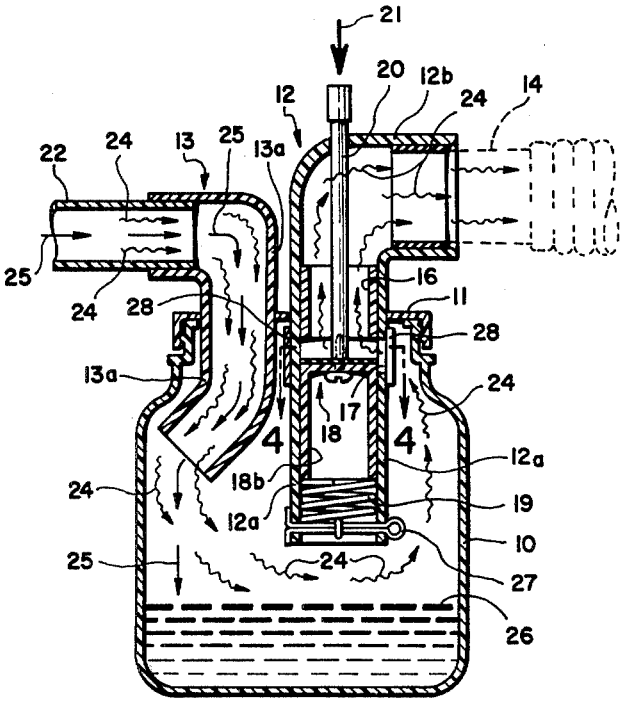
FIG. 3 is a view similar to that of FIG. 2, showing the valve means in the nozzle to which the vacuum cleaner hose is attached in its open position and diagramatically illustrating the flow of air and liquid in the system.
Figure 2:
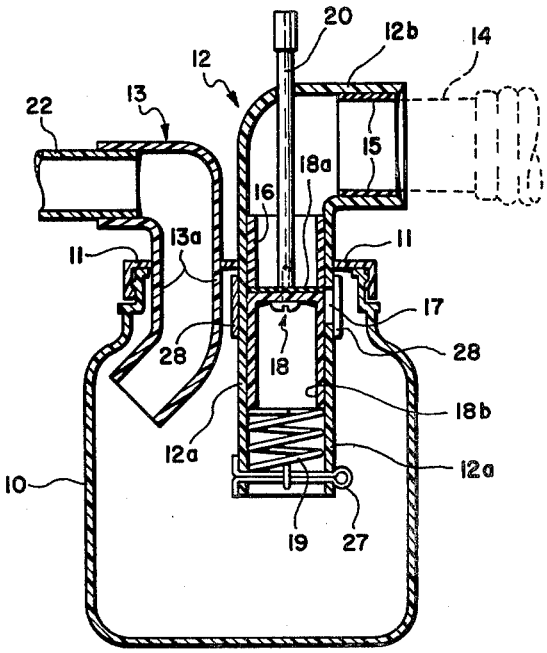
FIG. 2 is a vertical cross-section taken along line 2—2 of FIG. 1, showing the end of a suction hose of a conventional vacuum cleaner in phantom attached to the unit.

Valve means are provided in combination with the first nozzle 12 for opening and closing the flow passageway through the nozzle 12. Preferably, the valve means is built into the nozzle 12 as shown in the drawings. The nozzle 12 comprises a hollow, tubular section **12*a* whose longitudinal axis is substantially normal to the top of the cover 11 and extends upwardly and downwardly from the cover 11. The tubular section 12*a* has an opening 17 in its sidewall, with the opening being located above the bottom end of the section 12*a* and below the underside of cover 11. A hollow cap member 12*b* is integrally attached to the upper end of tubular section 12*a*. The cap member 12*b* has first and second openings therein. The first opening is adapted to receive the end 14 of a suction hose of a vacuum cleaner. A plunger 20 fits in the second opening as will be described hereinafter. A tightly fitting, hollow, tubular sleeve member 16 is attached to the inside surface of the hollow, tubular section 12*a* so that the lower end thereof is positioned adjacent to the upper edge of the opening 17 and just below the cover 11. A plug member 18 is adapted to releasably engage the lower end of the insert 16. As shown in FIGS. 2 and 3, the plug member 18 comprises a disc-shaped end 18*a* and a cylindrical portion 18*b* attached to the lower surface of the disc-shaped end 18*a*. The cylindrical portion 18*b* is positioned coaxial within the tubular section 12*a* (which has a cylindrical shape as shown in the drawings) of nozzle 12. The cylindrical portion 18***b* is adapted for reciprocating motion along its longitudinal axis and is guided in such movement by the portion of the tubular section 12*a* which extends beyond the sleeve member 16. Spring means 19 is adapted to exert a constant upward force on the plug member 18, so that the plug member 18 is biased in its upward position. When in its upward position, the plug member 18 engages the lower end of the insert 16 and the flow passageway through the nozzle 12 is blocked. A hand manipulated plunger 20 extends upwardly from its connection to the plug member 18, with the elongate axis of the plunger 20 being substantially parallel with the longitudinal axis of the tubular section 12*a*. The upper end of plunger 20, as mentioned hereinbefore, passes through the second opening in the cap member 12*b* of nozzle 12. The second opening in the cap member 12*b* makes close-fitting, sliding engagement with the plunger 20. When the plunger 20 is depressed in the direction shown by the arrow 21 in FIG. 3, a flow passageway is established for flow communication between the hollow portion of tubular section 12*a* above the lower end of the sleeve member 16 and the inside of the container 10 through the opening 17 in the side of the tubular section 12*a* of nozzle 12. The portion of the tubular section 12*a* of nozzle 12 located below the opening 17 is adapted to house the spring 19 and guide the plug member 18 in its reciprocating motion. The upper end of spring 19 engages the bottom side of the plug member 18 (as shown, the spring engages the bottom end of the cylindrical portion 18*b* of the plug member 18), and the lower end of the spring contacts a cotter pin 27 which extends across the lower end of the tubular section 12*a* and acts as a retainer to retain the spring 19 in place in the lower end portion of the tubular section 12*a*. When the plunger 20 is depressed downwardly, the spring 19 is compressed as shown in FIG. 3. When the plunger 20 is released, the compressed spring 19 pushes the plug member 18 and plunger 20 upwardly so that the plug member engages the lower end of the sleeve member 16.

In an alternate embodiment not shown in the drawings, the spring means 19 could be positioned above the plug member 18 thereby eliminating the need for the lower portion of the tubular section 12*a* of nozzle 12 which extends beyond the plug member. In such an embodiment the tubular section 12*a* would be terminated slightly below the cover 11, and the plug member 18 would abut against the terminal end of the tubular section 12*a*. The spring means 19 in an alternate embodiment would be repositioned coaxially above the plug member 18, preferably around the plunger 20. One end of the spring would be attached to the cap member 12*b* of nozzle 12 and the other end attached either to the plunger 20 or the plug member 18. Thus, in the alternate embodiment, the spring means would be extended when the plunger is depressed, and the spring would then pull the plug member back into abutment with the end of the nozzle when the plunger is released.

Referring again to the illustrated embodiment, the second nozzle 13 has an upstanding hollow, tubular section 13*a* which extends through the cover 11 into the container 10. The nozzle 13 has an angled portion 13*b* within the container which is directed away from the center of the container 10 towards the side of the container 10. The other end of nozzle 13 is adapted to be connected to one end of a scavenger hose 22. The other end of the scavenger hose 22 is attached to a pickup nozzle 23.

In operation, the suction hose of a vacuum cleaner is attached to nozzle 12 and the vacuum cleaner is turned on. The plunger 20 is depressed while holding the container 10 in an upright position, and the pickup nozzle 23 on the scavenger hose 22 is directed to the area which is to be cleaned. Liquid and air is aspirated into the container 10, as is diagramatically illustrated in FIG. 3 wherein the aspirated air is shown by wavy arrows 24 and aspirated liuqid by straight arrows 25. As illustrated, the aspirated liquid collects as a body of fluid 26 in the container 10, and the air is further aspirated through the opening 17 in nozzle 12 to the suction hose 14 and ultimately to the vacuum cleaner which is not shown in the drawings.

The container 10 can be temporarily layed down during its use without taking any precaution to turn the vacuum cleaner off to avoid water being aspirated into the vacuum cleaner. As the container is set down, the plunger is released and the plug member 18 automatically closes and prevents aspiration of air or liquid to the vacuum cleaner even when the vacuum cleaner continues to operate. Liquid can also be emptied from the container without turning the vacuum cleaner off. By releasing the plunger and thereby closing the valve means in nozzle 12, the vacuum in container 10 is dissipated and the container 10 can easily be removed from the cover 11, and, of course, there is no risk of aspirating liquid into the vacuum cleaner during the removal of the container.

Figure 4:
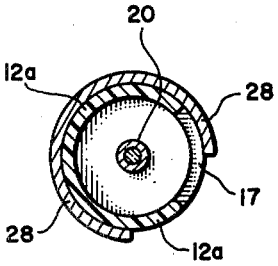
FIG. 4 is a cross-sectional view taken along line 4—4 of FIG. 3.

The amount of power (suction and air volume) varies widely with different vacuum cleaners. The preferred embodiment of the attachment of this invention, as illustrated in the drawings, is designed to operate within a wide power range by providing a dampening element which can be used to limit the volume of air aspirated through the container 10. As shown in FIGS. 2–4, the damping element comprises a slip ring 28 which partially surrounds the circumference of the tubular section 12*a* of nozzle 12. The slip ring 28 is adapted to revolve about an axis coinciding with the axis of the tubular section 12*a* and is positioned so that as the slip ring 28 revolves, the opening 28*a* therein can be brought into alignment with the opening 17 in the tubular section 12*a*. Also, the slip ring 28 can be revolved so that it gradually covers the opening 17. Thus, the effective size of the opening 17 is readily adjusted by appropriate movement of the slip ring 28. By adjusting the slip ring 28, the device of this invention can be made to operate at its optimum efficiency corresponding to the power of the vacuum cleaner being used. For example, if a vacuum cleaner is being used which has a very large air volume capacity, the slip ring 28 is adjusted to close the effective size of the opening 17 so that the liquid being collected in the container is not agitated to a degree that it is entrained in the air being aspirated through opening 17 by the vacuum cleaner. For vacuum cleaners having smaller air volume capacities, the slip ring 28 is adjusted to increase the effective size of the opening 17 to obtain the same efficient operation.

Whereas this invention is here illustrated and described with reference to preferred embodiments which are presently contemplated as encompassing the best mode of carrying out the invention, it is to be understood that various changes may be made in adapting the invention to different embodiments without departing from the inventive concepts disclosed herein and comprehended by the claims that follow.

I claim:

1. A portable attachment for vacuum cleaners which permits pickup of liquids as well as solids with the aspirated air, said attachment comprising:

a portable container;

a removable cover on said container, said cover making a substantially air-tight connection with said container;

a pair of nozzles on said cover, said nozzles providing fluid flow communication between the inside and outside of said container;

means for attaching the suction hose of a vacuum cleaner to the first nozzle of said pair of nozzles;

valve means in combination with said first nozzle, said valve means being spring biased in the closed position so that fluid flow communication between the inside of said container and the suction hose of the vacuum cleaner is established only when the valve means is activated to its open position;

a scavenger hose adapted to convey a mixture of air and liquids; and means for attaching one end of said scavenger hose to the second nozzle of said pair of nozzles.

2. A portable attachment for vacuum cleaners in accordance with claim 1, wherein said first nozzle comprises:

an upstanding, hollow, tubular section whose longitudinal axis is substantially normal to the top of the cover; and a hollow cap member at the top of said upstanding section, said cap member having first and second openings therein, with the first opening being adapted to receive the end of a suction hose of a vacuum cleaner; and wherein said valve means comprises:

a hand manipulated, elongate plunger element positioned within the hollow portion of said upstanding tubular section, with the elongate axis of said plunger element being substantially parallel with the longitudinal axis of the upstanding tubular section, said plunger element extending through said second opening in said cap member for sliding, reciprocal movement through said second opening;

a plug member attached to the lower end of said plunger element, said plug member being adapted to abut against the bottom of the upstanding tubular section and thereby close-off the hollow portion of said upstanding tubular section from the inside of the container when the plunger element is in its upwardmost position, and open the hollow portion of said upstanding tubular section for fluid flow communication with the inside of the container when the plunger element is depressed; and spring means for biasing the plunger element and plug member in their upwardmost position.

3. A portable attachment for vacuum cleaners in accordance with claim 1, wherein said first nozzle comprises:

a hollow, tubular section whose longitudinal axis is substantially normal to the top of the cover and extends upwardly and downwardly from the cover, said tubular section having an opening in its sidewall, with said opening being located above the bottom end of the tubular section and below the underside of the cover;

a hollow, tubular, sleeve member attached to the inside surface of said hollow tubular section so that the lower end of the sleeve member is positioned adjacent to the upper edge of said opening in the sidewall of said tubular section; and a hollow cap member at the top of said tubular section, said cap member having first and second openings therein, with the first opening being adapted to receive the end of a suction hose of a vacuum cleaner; and wherein said valve means comprises:

a hand manipulated, elongate plunger element positioned within the hollow portion of said tubular section, with the elongate axis of said plunger element being substantially parallel with the longitudinal axis of said tubular section, said plunger element extending through said second opening in said cap member for sliding, reciprocal movement therethrough;

a plug member attached to the lower end of said plunger element and positioned below the lower end of the sleeve member in said tubular section; said plug member being guided in reciprocal movement to and from abutting engagement with the lower end of said sleeve member by the portion of said tubular section extending downwardly beyond said sleeve member, said plug member being adapted to close off the hollow portion of said tubular section above the lower end of said sleeve member from the inside of said container when the plunger element and plug member are in their upwardmost position with the plug member abutting the lower end of said sleeve member; and spring means for biasing the plunger element and plug member in their upwardmost position.

4. A portable attachment for vacuum cleaners in accordance with claim 3, wherein said spring means comprises a spring located within the hollow portion of the tubular section below the plug member, wherein the upper end of said spring engages the bottom side of said plug member and the lower end of said spring contacts a retaining member at the lower end of said tubular section, whereby said spring is compressed when the plunger element is depressed downwardly and then pushes the plunger element and plug member upwardly when the plunger element is released.

* * * * *